US010488161B2

(12) United States Patent
Anderson et al.

(10) Patent No.: US 10,488,161 B2
(45) Date of Patent: Nov. 26, 2019

(54) WALKING TARGET

(71) Applicant: Action Target Inc., Provo, UT (US)

(72) Inventors: Devin Anderson, Orem, UT (US); Christopher Hess, Santaquin, UT (US)

(73) Assignee: Aciton Target Inc., Provo, UT (US)

( * ) Notice: Subject to any disclaimer, the term of this patent is extended or adjusted under 35 U.S.C. 154(b) by 0 days.

(21) Appl. No.: 15/840,938

(22) Filed: Dec. 13, 2017

(65) Prior Publication Data

US 2018/0172409 A1 Jun. 21, 2018

Related U.S. Application Data

(60) Provisional application No. 62/435,294, filed on Dec. 16, 2016.

(51) Int. Cl.
*F41J 7/04* (2006.01)
*F41J 9/02* (2006.01)

(52) U.S. Cl.
CPC ... *F41J 9/02* (2013.01); *F41J 7/04* (2013.01)

(58) Field of Classification Search
CPC ..... F41J 7/04
USPC ..... 273/386–392, 403–410
See application file for complete search history.

(56) References Cited

U.S. PATENT DOCUMENTS

| | | | | |
|---|---|---|---|---|
| 4,524,976 | A * | 6/1985 | Seitz | F41J 7/04 273/388 |
| 6,896,267 | B1 * | 5/2005 | Le Anna | F41J 7/04 273/391 |
| 7,114,725 | B2 * | 10/2006 | Camp | F41J 1/10 273/390 |
| 7,175,181 | B1 * | 2/2007 | Bateman | F41J 7/04 273/392 |
| 7,448,967 | B1 * | 11/2008 | Panneri | A63B 57/10 473/387 |
| 8,413,991 | B2 | 4/2013 | Sudbeck et al. | |
| 8,490,978 | B2 | 7/2013 | Rogers | |
| 8,556,269 | B2 | 10/2013 | Berger et al. | |
| 9,482,498 | B1 * | 11/2016 | Miller | F41J 7/04 |
| 9,513,091 | B2 * | 12/2016 | Roberts | F41J 1/01 |
| 2011/0024985 | A1 * | 2/2011 | Potterfield | F41J 1/01 273/348 |
| 2011/0062668 | A1 * | 3/2011 | Leimberer | A63F 9/0204 273/407 |
| 2013/0207347 | A1 * | 8/2013 | Sovine | F41J 5/205 273/390 |
| 2018/0299232 | A1 * | 10/2018 | Thompson | F41J 1/10 |

* cited by examiner

*Primary Examiner* — Mark S Graham
(74) *Attorney, Agent, or Firm* — Bateman IP

(57) ABSTRACT

A walking target may include a plurality of target impact areas which are oriented in at least two different planes so that a plurality of target impact areas rest on a surface and hold one target impact area generally upright. The walking target may be formed from a single piece of metal.

19 Claims, 11 Drawing Sheets

WALKING TARGET

BACKGROUND

1. Field of the Invention

The present invention relates to a target for use with projectiles. In particular, the present invention relates to a target which advances each time it is struck by a projectile, such as a bullet, so as to provide an entertaining way in which to conduct target practice and increase the difficulty after each successful shot.

2. State of the Art

There are a wide variety of targets which may be used to improve accuracy when using a weapon, such as a bullet fired from a gun or another projectile, such as an arrow launched from a bow. Some targets are fairly static and become somewhat monotonous to train on. Other targets move so as to change the focal point of the shooter with each shot. Still other targets can be used in such a manner as to create competition between shooters to thereby heighten the level of stress or anxiety to more closely match a real-life shooting situation. Such targets are also generally more enjoyable to use as a person practices their shooting.

One such type of target commonly available is a walking target. In a walking target, the target has a plurality of arms with target impact areas disposed three-dimensionally about the target along the arms. For example, the walking target may have four target impact areas which are disposed remotely from each other in a generally pyramidal shape so that three of the target impact areas rest on the ground, while a fourth target impact area is raised upwardly to serve as the intended target. As a shooter's projectile hits the raised target impact area, the force of the projectile deflects the target impact area and associated arm, thereby causing the target to rotate and move advance away from the shooter. Depending on how forcefully the target is struck, the target will rotate, thereby causing one of the other target impact areas to be raised and presented to the shooter as the target moves away from the shooter. (In some circumstances the target may be hit with sufficient force that target rotates all the way around so that the initially presented target is once again presented to the shooter, but typically at a location distant from the original position) Thus, the shooter must re-aim after each successful shot. By repeated successful hits on the target, the shooter can make the target "walk" away from him or her.

One problem with walking targets is how to form the target. As shown in FIG. 1, in one common embodiment a first target impact area 4 and a second target impact area 8 are disposed at opposite ends of a curved or bent arm 12. The arm 12 may have portions 12*a* which extend from a central location, which may include a notch 16. This is typically cut from a single piece of metal.

As shown in FIG. 2, a similar piece having an arm with two portions 12*b* (only 1 of which is visible in FIG. 2) and two target impact surfaces engages the first piece perpendicularly at a 90-degree angle so that each of the centers 20 of the target pieces nest in the notch 16 of the other piece, thereby forming a generally pyramidal shape between the various impact areas. The two pieces of metal are then attached to each other either by welding the two pieces together, or by having a flange which engages both pieces and has bolts or screws which attach the pieces together. The targets can also be formed with compliant members engaging each other in the notches.

Such a configuration leaves three target impact areas resting on the ground and one target impact area 4' extending generally upwardly so that it can be struck by a bullet or other projectile. Thus, as shown in FIG. 3, target impact areas 4, 8 and 8' are resting on the ground while target impact area 4' is raised above the centers 20. Each solid impact to the target impact area with a projectile causes the walking target to rotate due to the force of the impact—thereby causing it to advance with the upper-most impact plate pivoting downwardly and another impact plate rotating upwardly and taking its place for the next shot. In some situations, the target may rotate all the way around so that target impact area 4' is again presented.

While walking targets are enjoyable, they suffer from some deficiencies. Because they are formed from two or more pieces of metal they must be held together in order for the walking target to work. This is most conventionally done by welding the first and second pieces together in such a way that each arm portion 12*a*, 12*b* extends outwardly approximately 109.5 degrees from the others to form a pyramid. In other arrangements, the two pieces are bolted together.

One problem with welding the two pieces together is that welds are susceptible to damage due to vibration. Because the target is repeatedly struck with bullets, vibrations travel through the arms and can weaken or even break the weld over time. Welding also takes time and adds to the cost of the target.

Likewise, repeated vibrations can cause a bolt to come lose thereby causing the target to come apart. The use of bolts to hold the two parts together takes time and increased expense due to the need to purchase bolts and flanges. Additionally, bolts and flanges increase the number of surfaces which can direct splatter back at the shooter, thereby potentially decreasing the safety of the device.

Thus, there is a need for a walking target which addresses one or more of these concerns.

SUMMARY OF THE DISCLOSURE

The present disclosure relates to a new walking target which can be formed without the need for welds or bolts.

In accordance with one aspect of the present disclosure, the walking target may be formed from a single piece of metal.

In accordance with another aspect of the disclosure, the walking target may be formed from a flat piece of metal in which all four of the impact surfaces are formed in the same plane. The flat piece of metal is then bent so that two of the target impact areas are disposed in a different plane (generally perpendicular) to the plane(s) in which the other target impact areas are disposed.

In accordance with another aspect of the disclosure, the target impact areas may be formed in a variety of shapes and sizes.

In accordance with another aspect of the present disclosure, the walking target may include a first arm connecting the first and second target impact areas and a second arm connecting the third and fourth target impact areas, and a third arm extending between the first arm and the second arm, the third arm being twisted so that a first pair of target impact areas are disposed in a first plane and a second pair of target impact areas are disposed in a second plane generally perpendicular to the first plane.

In accordance with another aspect of the disclosure, the relative lengths of the first, second and third arms may be selected so as to change the position of the upper most target impact area to force the shooter to have more change in sighting while shooting the target.

It will be appreciated that various aspects of the disclosure may be present in various embodiments of a walking target and are not required as part of the invention unless the aspect is expressly set forth in the claims. The present summary of the disclosure represents various aspects which are discussed and should not be read as defining the invention, which is set forth in the claims.

BRIEF DESCRIPTION OF THE DRAWINGS

The above and other objects, features and advantages of the invention will become apparent from a consideration of the following detailed description presented in connection with the accompanying drawings in which.

Figure 1:
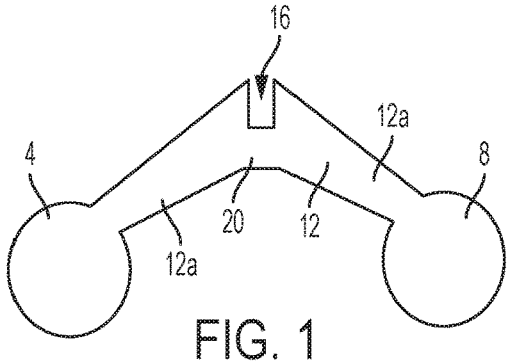
FIG. 1 PRIOR ART
FIG. 1 shows a plan view of one piece of prior art walking target.
Figure 2:
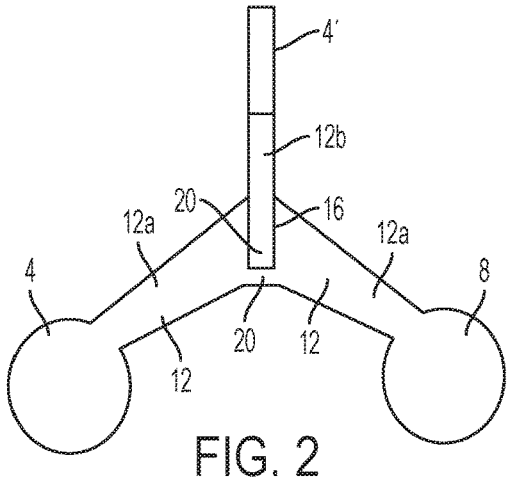
FIG. 2 PRIOR ART
FIG. 2 shows a top view of a prior art walking target in which two pieces are welded together.

It will be appreciated that the drawings are illustrative and not limiting of the scope of the invention which is defined by the appended claims. The various elements of the invention accomplish various aspects and objects of the invention. It is appreciated that not every element of the invention can be clearly displayed in a single drawing, and as such not every drawing shows each element of the invention.

DETAILED DESCRIPTION

The drawings will now be discussed in reference to the numerals provided therein so as to enable one skilled in the art to practice the present invention. The drawings and descriptions are exemplary of various aspects of the invention and are not intended to narrow the scope of the appended claims. It will be appreciated that the various aspects of the walking target discussed herein may be the same. Different reference numerals may be used to describe similar structures in the various lead collection systems for clarity purposes only. Furthermore, it will be appreciated that the drawings may show some aspects of the invention in isolation and the elements in one figure may be used in conjunction with elements shown in other figures.

Reference in the specification to "one configuration," "one embodiment" "one aspect" or "a configuration," "an embodiment" or "an aspect" means that a particular feature, structure, or characteristic described in connection with the configuration may be included in at least one configuration and not that any particular configuration is required to have a particular feature, structure or characteristic described herein unless set forth in the claim. The appearances of the phrase "in one configuration" or similar phrases in various places in the specification are not necessarily all referring to the same configuration, and may not necessarily limit the inclusion of a particular element of the invention to a single configuration, rather the element may be included in other or all configurations discussed herein. Thus it will be appreciated that the claims are not intended to be limited by the representative configurations shown herein. Rather, the various representative configurations are simply provided to help one of ordinary skill in the art to practice the inventive concepts claimed herein.

Furthermore, the described features, structures, or characteristics of embodiments of the present disclosure may be combined in any suitable manner in one or more embodiments. In the following description, numerous specific details may be provided, such as examples of products or manufacturing techniques that may be used, to provide a thorough understanding of embodiments of the invention. One skilled in the relevant art will recognize, however, that embodiments discussed in the disclosure may be practiced without one or more of the specific details, or with other methods, components, materials, and so forth. In other instances, well-known structures, materials, or operations may not be shown or described in detail to avoid obscuring aspects of the invention.

Before the present invention is disclosed and described in detail, it should be understood that the present invention is not limited to any particular structures, process steps, or materials discussed or disclosed herein. More specifically, the invention is defined by the terms set forth in the claims. It should also be understood that terminology contained herein is used for the purpose of describing particular aspects of the invention only and is not intended to limit the invention to the aspects or embodiments shown unless expressly indicated as such. Likewise, the discussion of any particular aspect of the invention is not to be understood as a requirement that such aspect is required to be present apart from an express inclusion of that aspect in the claims.

It should also be noted that, as used in this specification and the appended claims, singular forms such as "a," "an," and "the" may include the plural unless the context clearly dictates otherwise. Thus, for example, reference to "an arm" may include an embodiment having one or more of such arm, and reference to "the target impact area" may include reference to one or more of such target impact areas.

As used herein, the term "substantially" refers to the complete or nearly complete extent or degree of an action, characteristic, property, state, structure, item, or result to function as indicated. For example, an object that is "substantially" enclosed would mean that the object is either completely enclosed or nearly completely enclosed. The exact allowable degree of deviation from absolute completeness may in some cases depend on the specific context, such that enclosing the nearly all of the length of a lumen would be substantially enclosed, even if the distal end of the structure enclosing the lumen had a slit or channel formed along a portion thereof. The use of "substantially" is equally applicable when used in a negative connotation to refer to the complete or near complete lack of an action, characteristic, property, state, structure, item, or result. For example, structure which is "substantially free of" a bottom would either completely lack a bottom or so nearly completely lack a bottom that the effect would be effectively the same as if it completely lacked a bottom. Likewise, an indication that two target impact areas are in substantially in the same plane would mean that the target impact areas may be bent relative to one another by, for example, up to 4-5 degrees.

As used herein, the terms "about" or "generally" are used to provide flexibility to a numerical range endpoint by providing that a given value may be "a little above" or "a little below" the endpoint while still accomplishing the function associated with the range. Thus, for example, a target impact area may extend generally vertically—meaning that it is more vertical than horizontal without requiring that the target impact area be held at 90 degrees from the horizontal. Likewise, an indication that two target impact areas are in substantially in the same plane would mean that the target impact areas may be bent relative to one another by, for example, up to, for example 15 degrees.

As used herein, a plurality of items, structural elements, compositional elements, and/or materials may be presented in a common list for convenience. However, these lists should be construed as though each member of the list is individually identified as a separate and unique member.

Concentrations, amounts, proportions and other numerical data may be expressed or presented herein in a range format. It is to be understood that such a range format is used merely for convenience and brevity and thus should be interpreted flexibly to include not only the numerical values explicitly recited as the limits of the range, but also to include all the individual numerical values or sub-ranges encompassed within that range as if each numerical value and sub-range is explicitly recited. As an illustration, a numerical range of "about 1 to about 5" should be interpreted to include not only the explicitly recited values of about 1 to about 5, but also include individual values and sub-ranges within the indicated range. Thus, included in this numerical range are individual values such as 2, 3, and 4 and sub-ranges such as from 1-3, from 2-4, and from 3-5, etc., as well as 1, 2, 3, 4, and 5, individually. This same principle applies to ranges reciting only one numerical value as a minimum or a maximum. Furthermore, such an interpretation should apply regardless of the breadth of the range or the characteristics being described.

The invention and accompanying drawings will now be discussed in reference to the numerals provided therein so as to enable one skilled in the art to practice the present invention. The drawings and descriptions are intended to be exemplary of various aspects of the invention and are not intended to narrow the scope of the appended claims. Furthermore, it will be appreciated that the drawings may show aspects of the invention in isolation and the elements in one figure may be used in conjunction with elements shown in other figures.

Figure 4:
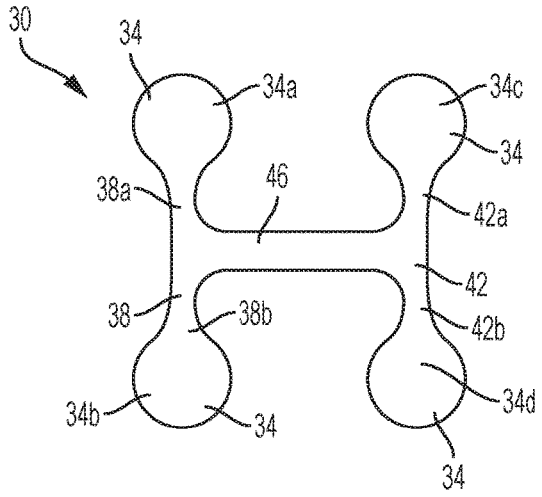
FIG. 4 shows a plan view of a target formed in accordance with one aspect of the present disclosure.

Turning to FIG. 4, there is shown a target, generally indicated at 30, which may be formed from a single plate or piece of metal. Commonly the target 30 is formed from steel. Either mild or hardened steel, such as AR500, may be used depending on the intended use of the target. For example, a target designed for use with .22 caliber long rifle bullets may be mild steel, while targets for larger caliber pistols and rifles may be hardened steel. The steel may be cut from a single plate or piece of steel using known technology including, but not limited to, plasma cutters, high pressure water, laser cutting, milling and/or a number of other cutting techniques.

Figure 20:
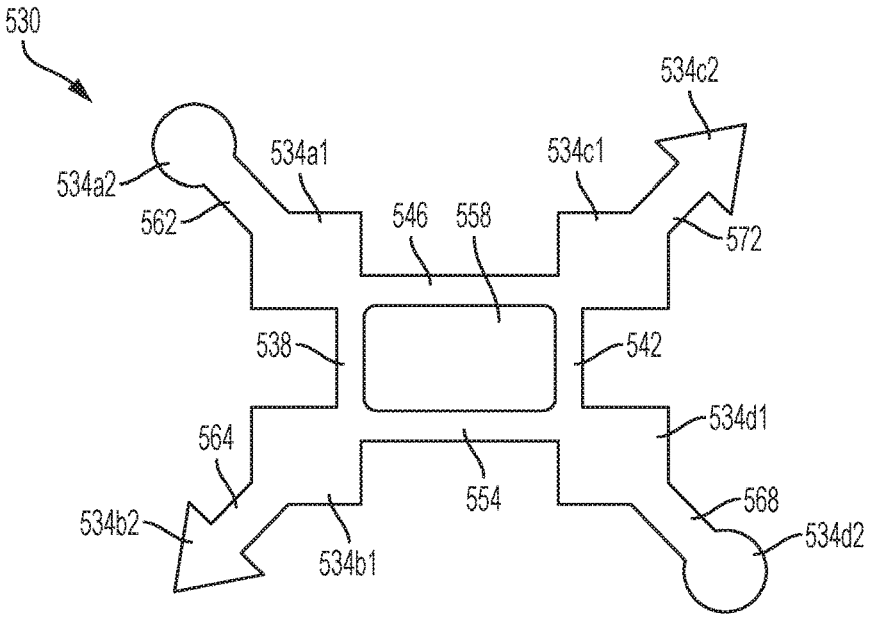
FIG. 20 shows a plan view of yet another configuration in which a plurality of target areas are disposed on one or more arms.

The target 30 may include a plurality of target impact areas 34. While shown as being generally rounded in FIG. 3, the target impact areas may be any shape. The target impact areas as shown include a first target impact area 34*a*, a second target impact area 34*b*, a third target impact area 34*c* and a forth target impact area 34*d*. The first target impact area 34*a* and the second target impact area 34*b* are attached together by a first arm 38. The target impact areas 34*a*, 34*b* may be at least twice as wide as the arm to be easily visible. Such a configuration reduces risk of a round hitting the arm apart from the target impact areas. While it is typical that the target impact areas 34*a* and 34*b* would be at the far ends of the arms, this is not required. Additionally, as shown in FIG. 20, multiple target impact areas could be disposed on each arm.

Similarly, the third target impact area 34*c* and the fourth target impact area 34*d* are attached together by a second arm 42. The first arm 38 and the second arm 42 are attached together by a third arm 46 or connection extending between the two. As shown in FIG. 4, the third arm 46 may extend generally perpendicular to the first arm 38 and the second arm 42. The third arm 46 may also be attached in the middle of each of the first arm 38 and the second arm 42 so as to divide the arms into first portions 38*a* and 42*a*, respectively, and second portions 38*b* and 42*b*, respectively.

The exact size of the target can be changed to provide different performance characteristics. For example, the smaller the target, the easier it will be to get it to rotate upon impact. Thus, a larger, heavier target may be used for high caliber rounds. Likewise, by selecting the length of the first arm 38, second arm 42 and third arm 46 to each other, or by adjusting the size of the target impact areas, the manner in which the target is presented to the shooter may change. For example, the target can be made such that the first target impact area 34*a* is disposed substantially over a center point of a triangle formed by the second, third and fourth target impact areas, 34*b*, 34*c* and 34*d*. When the first target area 34*a* is struck, the target 30 will rotate, thereby lifting the fourth target impact area 34*d* (or the target impact area closest to the shooter) to the upper position substantially above the center of a triangle formed by the first, second and third target impact areas 34*a*, 34*b* and 34*d*, respectively. However, by making the first and second arms 38 and 42 shorter or the third arm 46 longer, the raised target impact area can be moved toward one end of the triangle—thereby creating more movement in the location of the target impact area with each rotation of the target 30.

Figure 3:
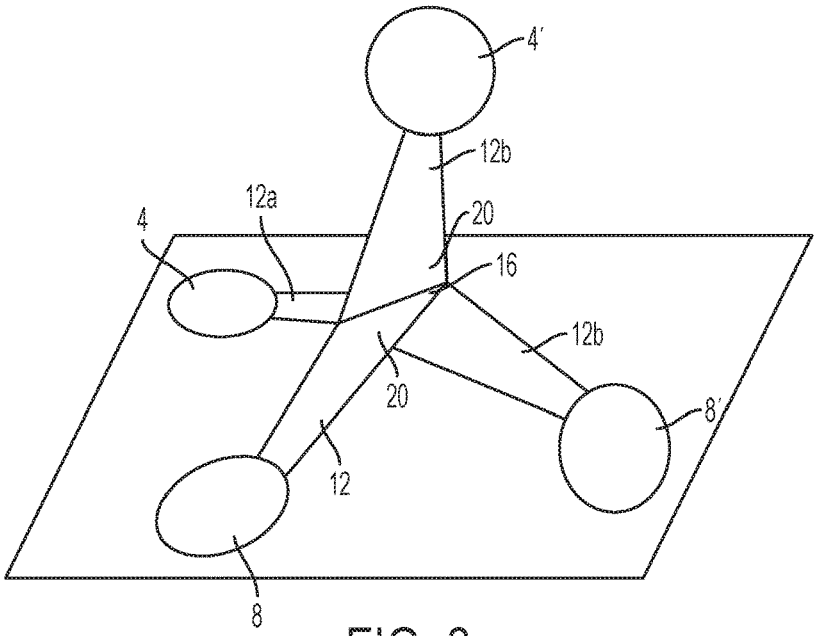
FIG. 3 PRIOR ART
FIG. 3 shows a perspective view of the walking target of FIG. 2 resting on a surface.
Figure 5:
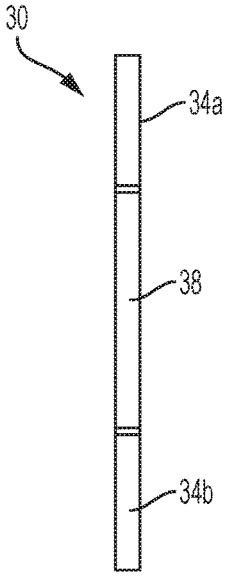
FIG. 5 shows a side view of the target of FIG. 4.

Turning now to FIG. 5, there is shown a side view of the target 30 of FIG. 3. It will be appreciated in light of the present disclosure that cutting the target 30 from a single piece of metal is advantageous as it avoids the need for welding or other fasteners which can break or which otherwise add to the expense of the target. A single piece target also minimizes the number of surfaces which can direct bullet splatter back toward the shooter.

Figure 6:
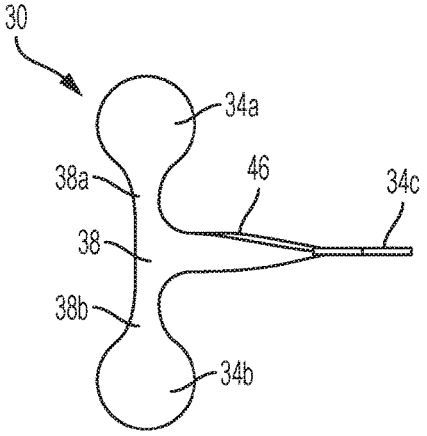
FIG. 6 shows a view of the target of FIG. 4, with the target having been twisted so that the two target impact areas on the right side are moved into a plane generally perpendicular to the plane in which the two target impact areas on the left are disposed.

FIG. 6 is a front view of the target 30. The target 30 has been twisted so that the third target impact area 34*c* and the fourth target impact area (not visible in FIG. 6) are disposed in a different plane than the first target impact area 34*a* and the second target impact area 34*b*. This has been accomplished by twisting the third arm 46 ninety degrees between opposing ends so that the two planes in which the target impact plates rest are generally or substantially perpendicular. With the target impact areas in such an orientation, the target will rest on the ground with two target impact areas in one plane and two target impact areas in the other plane. One target impact area extends upwardly and forms the target area for the shooter to shoot.

Figure 7:
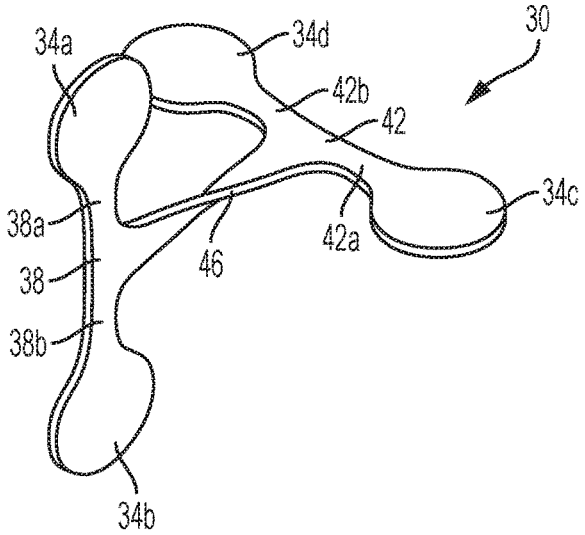
FIG. 7 shows a perspective view of the target of FIG. 3, after is has been bent or twisted as shown in FIG. 6.

FIG. 7 shows a perspective view of the target 30 after it has been twisted along the third arm 46. The second, third and fourth target impact areas 34*b*, 34*c* and 34*d*, respectively, are disposed downwardly for resting on a surface, while the first target impact area 34*a* is extending upwardly. It will be appreciated that the target 30 is bidirectional and either side may be shot at by the shooter. Likewise, it will be appreciated that the length of the arms 38, 42 and 46 will determine how far over the center of the target the upwardly extending target impact area extends.

Figure 8:
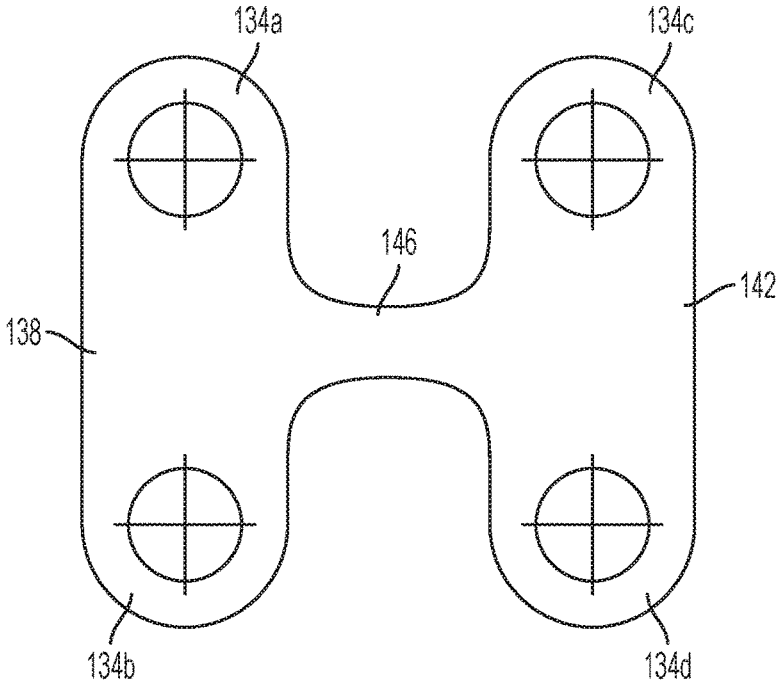
FIG. 8 shows a plan view of an alternate configuration of a target made in accordance with the teachings of the present disclosure.

FIG. 8 shows a plan view of an alternate configuration of a target 130 formed in accordance with the present disclosure. The target includes a first arm 138 having a first target impact area 134*a* at one end and a second target impact area 134*b* at an opposing end. The target 130 further includes a second arm 142 having a third target impact area 134*c* and a fourth target impact area 134*d* at opposing ends thereof. A third arm, connector or extension 146 connects the first arm 138 and the second arm 142. It will be appreciated that the arms 138, 142 and 146 could be a variety of different shapes and sizes.

The third arm 146 may be twisted similar to the third arm 46 discussed in FIGS. 4-7 so that the first and second target impact areas 134*a*, 134*b* are in substantially in one plane, while the third and fourth target impact areas 134*c*, 134*d* are substantially in another plane (often substantially perpendicular to the first).

Figure 9:
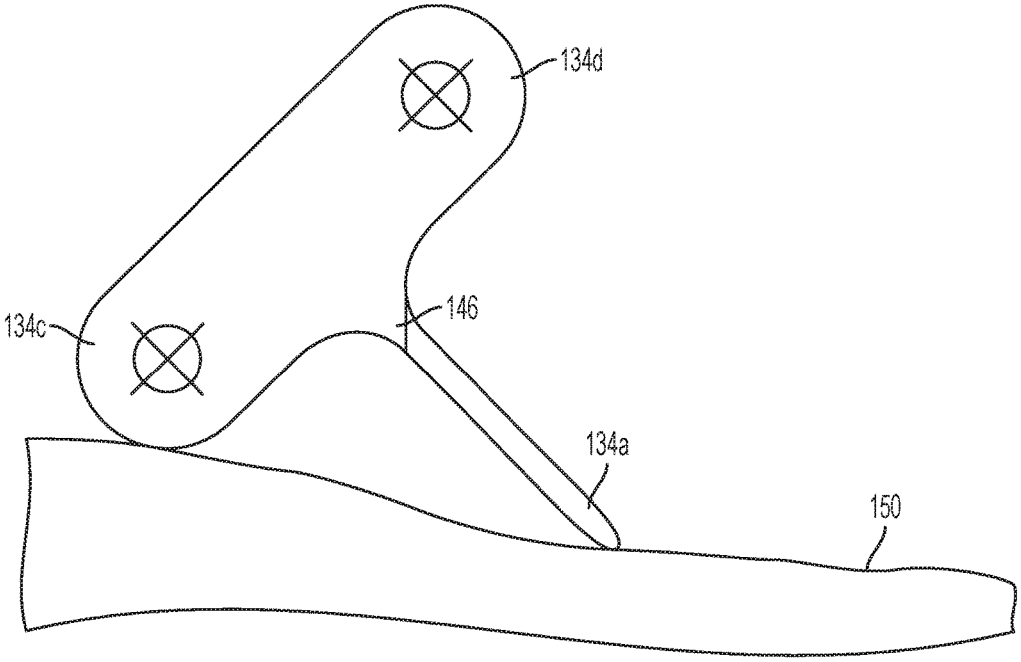
FIG. 9 shows a front view of the target of FIG. 8 disposed on the ground, with the target twisted so that the two target impact areas on the right side are moved into a plane generally perpendicular to the plane in which the two target impact areas on the left are disposed.

FIG. 9 shows a side view of the target 130 after the third arm 146 has been twisted and wherein the target is disposed on a surface 150 with three of the target impact areas resting on the surface, and a fourth 134*d* extending generally upwardly. Each time a bullet forcefully impacts the upper target impact area (134*d* in the this view), the target 130 typically rotates into a new position, thereby causing the target to turn one-quarter turn, thereby causing the target "to walk." (It will be appreciated that a shot which merely grazes an edge of the target impact area may be insufficient to cause the target 130 to rotate).

Figure 10:
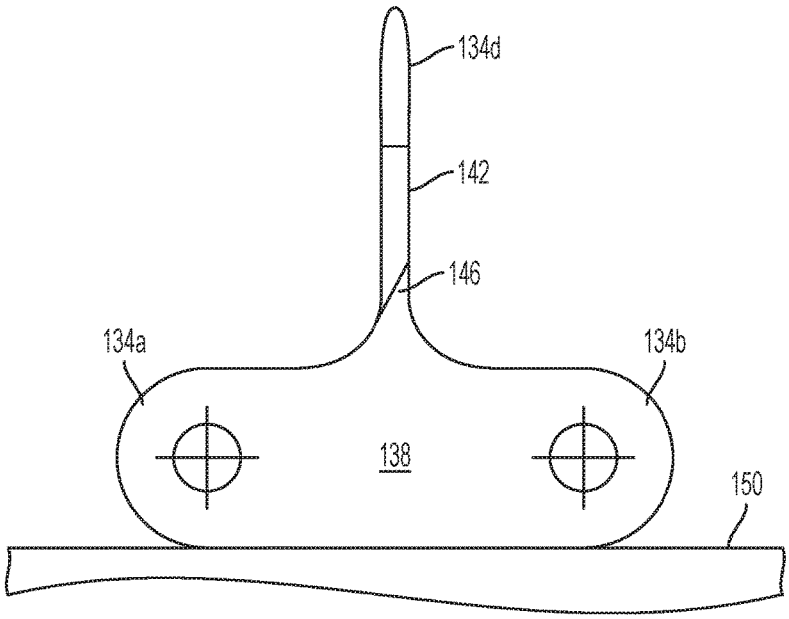
FIG. 10 shows a side view of the target of FIG. 9 resting on the ground.

FIG. 10 shows a view of the target rotated 90 degrees so as to show the first target impact area 134*a* and the second target impact area 134*b* of the first arm 138 sitting on the ground, while the second arm 142 holds the fourth impact area 134*d* above and generally centralized over the other three. One advantage of the targets discussed herein is that they can be used on uneven ground, such as one is likely to find when camping. The slope of the ground can add an extra challenge in getting the target to "walk" in the direction desired.

Figure 11:
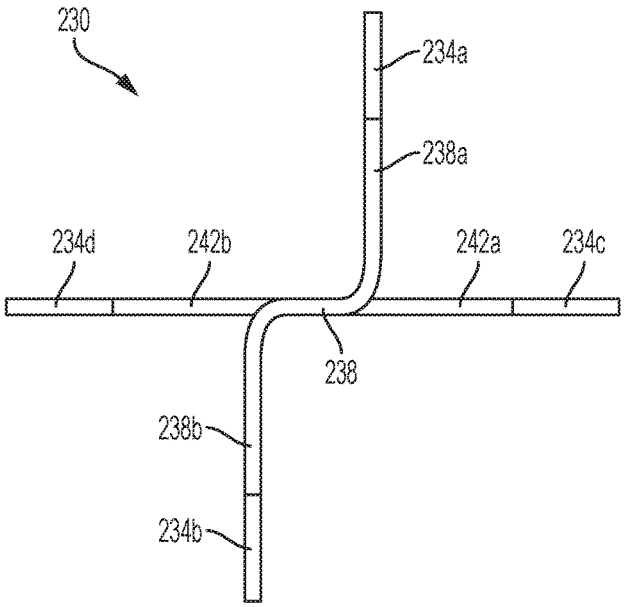
FIG. 11 shows an alternate configuration similar to that shown in FIG. 3, but wherein the first arm has been bent in two places to position two target impact areas generally perpendicular to the other two target impact areas, but in different planes.
Figure 12:
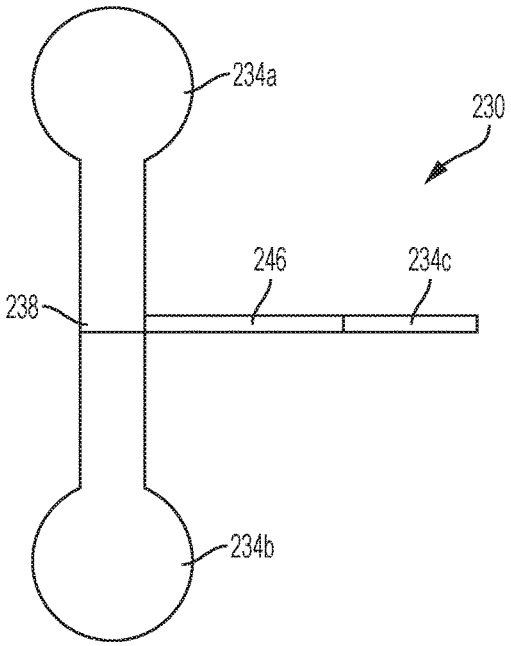
FIG. 12 shows an alternate view of the target of FIG. 11.

FIGS. 11 and 12 show an end and a top view of an alternate configuration of a target, generally indicated at 230. Rather than the arm 246 being twisted, the upper portion 238*a* and the lower portion 238*b* of the first arm 238 have been bent so that the first target impact area 234*a* and the second target impact area 234*b* are disposed generally perpendicular to the third and fourth target impact areas 234*c* and 234*d*. While the figures show both portions 238*a* and 238*b* bent at approximately 90 degree angles, each of the arms 238 and 242 could be bent along each portion at approximately 45 degrees.

Figure 13:
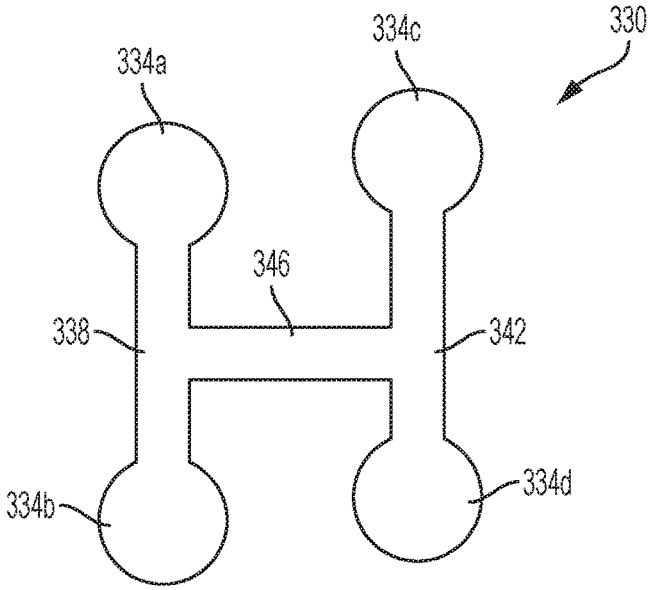
FIG. 13 shows an alternate configuration in which portions of the arms are different lengths.

Turning now to FIG. 13, there is shown yet another configuration of a target 330 made in accordance with the present disclosure. While the target 330 includes a first target impact area 334*a*, a second target impact areas 334*b*, a third target impact area 334*c* and a fourth target impact area 334*d*, as well as a first arm 338, a second arm 342 and a third arm 346, the attachment of the third arm is offset from center on both of the other arms. Once bent or twisted, this causes the target to move inconsistently when impacted by a round, thereby requiring the shooter to adapt to a greater variation in the location of the target impact area 334*a*, 334*b*, 334*c* or 334*d* which is being presented to the shooter.

Figure 14:
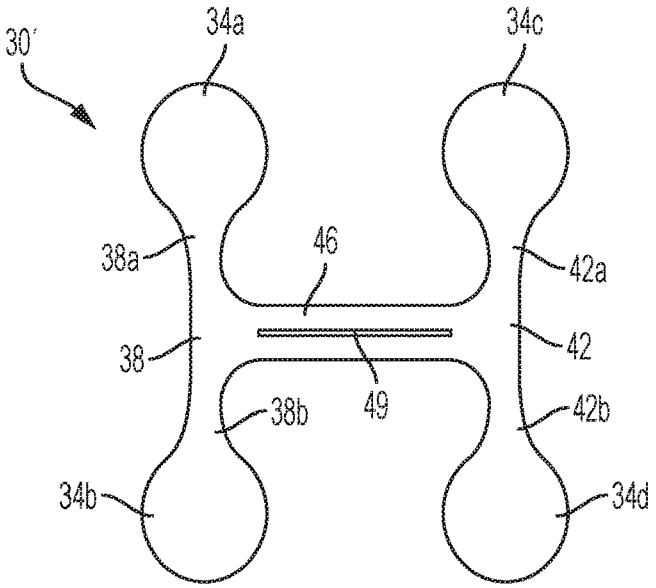
FIG. 14 shows a plan view of an alternate configuration of a target similar to that shown in FIG. 3.

FIG. 14 shows a plan view of another configuration of a walking target, generally indicated at 30'. The walking target 30' is substantially the same as the target 30 in FIG. 4 and is numbered accordingly. The description regarding FIG. 4 is incorporated herein by reference.

The one difference in FIG. 13 is that a slot 49 is formed into the third arm 46. The slot 49 can be used for multiple purposes. First, the slot reduces the weight of the target. To this end, one or more slots could also be formed in the first arm 38 and the second arm 42 to minimize the weight. Those skilled in the art will appreciate that a lighter weight target will be easier to use with bullets having a smaller mass and less velocity, such as the bullet from a 9 mm or 0.22 long rifle. For a pellet guns and the like, a much lighter material such as tin or plastic could be used. In contrast, for high caliber, high velocity rounds, such as a 30-06 or larger, a heavier target may be used, such as one formed from approximately 0.95 centimeter or 1.27 centimeter steel (3/8$^{th}$ or ½ inch steel). Additionally, the target 30' may be larger to allow for it to be more easily shot at greater distances.

Figure 15:
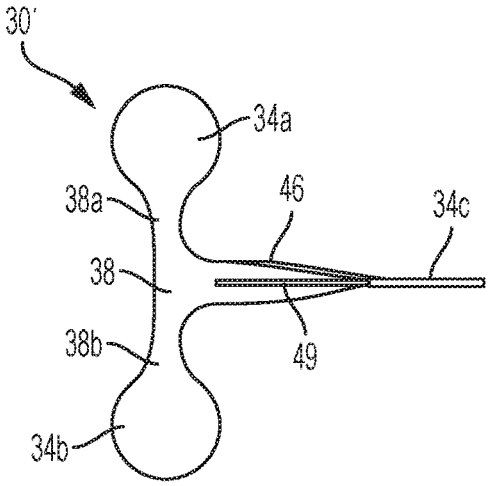
FIG. 15 shows a side view of the target of FIG. 14 after the target has been twisted into shape.

The slot 49 also has the benefit of providing stress relief in the third arm 46. The slot allows the third arm 46 to be twisted with less inherent stress as shown in FIG. 15. Similar to FIG. 5, the third arm 46 has been twisted so that the third target impact area 34*c* has been rotated toward the viewer so as to be generally perpendicular to first target impact area 34*a* and the second target impact area 34*b*. In normal use, the third target impact area 34*c* and the fourth target impact area (not visible) would be resting on the ground along with the second target impact area 34*b* while the first target impact area 34*a* is positioned above the other three.

Figure 16:
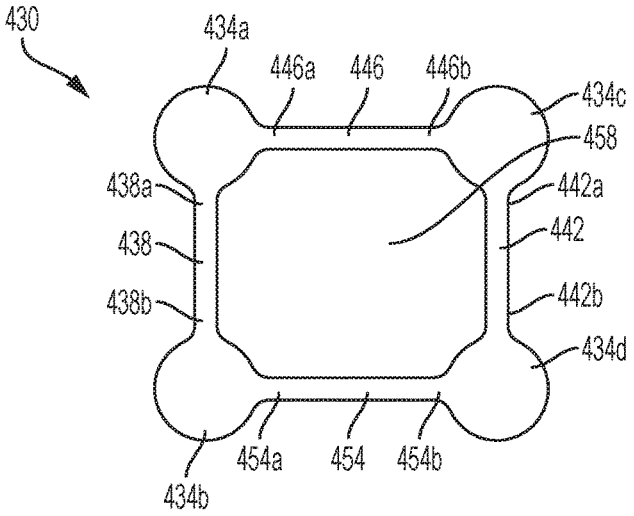
FIG. 16 shows a plan view of an alternate configuration of a target made in accordance with the principles of the present disclosure.

Turning now to FIG. 16, there is shown a plan view (pre-bending) of yet another configuration of a walking target, generally indicated at 430, made in accordance with the present disclosure. The walking target 430 may include a first target impact area 434*a*, a second target impact area 434*b*, a third target impact area 434*c* and a fourth target impact area 434*d*. The first target impact area 434*a* may be connected to the second target impact area 434*b* with a first arm 438, with the first target impact area being disposed at or near a first end 438*a* and the second target impact area being disposed at or near a second end 438*b*. Likewise, the third target impact area 434*c* and the fourth target impact area 434*b* may be connected with a second arm 442, with the third target impact area being disposed at or near a first end 442*a* of the second arm and the fourth target impact area being disposed at or near a second end 442*b* of the second arm.

Unlike the prior configurations, a third arm does not directly attach the first arm 438 to the second arm 442 to thereby pass through the generally middle of the target 430. Rather, a third arm 446 may be positioned to connect the first target impact area 434*a* to the third target impact area 434*c*, with the first target impact area being disposed at or near a first end 446*a* and the third target impact area being disposed at or near a second end 446*b* of the third arm. A fourth arm 454 may be used to connect the second target impact area 434*b* to the fourth target impact area 434*d*, with the second target impact area being disposed at or near the first end 454*a* and the fourth target impact area being disposed at or near the second end 454*b* of the fourth arm. In such a configuration, a void 458 may be left in the middle of the target 430.

The target 430 (and those discussed above) are effectively divided into two portions by bending one or more of the arms. The target impact areas of one portion, typically the first target impact area 434*a* and the second target impact area 434*b* are disposed generally parallel, if not co-planar with one another. The target areas of the other portion, typically the third target impact area 434*c* and the fourth target impact area 434*d*, are disposed generally parallel, if not co-planar with one another. After bending of the third arm 446 (and fourth arm 454 in the present embodiment), the target impact areas 434*a* and 434*b* of the first portion are disposed generally perpendicular to the target impact areas 434*c* and 434*d* of the second portion.

Figure 17:
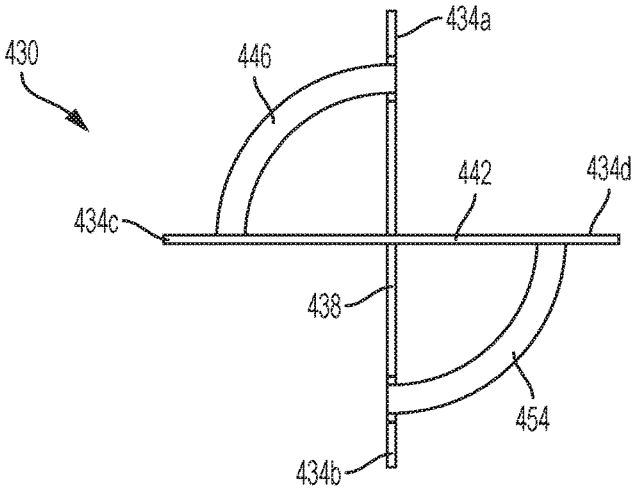
FIG. 17 shows an end view of the target of FIG. 16 after the target has been twisted into shape.

Turning now to FIG. 17, there is shown an end view taken from the right side of the configuration of FIG. 16 after the target 430 has been twisted. While the first arm 438 and the second arm 442 have remained generally straight so that the first target impact area 434*a* and the second impact area 434*b* remain substantially co-planar and the third target impact area 434*c* and fourth target impact area 434*d* remain substantially co-planar, the third arm 446 is twisted and the fourth arm 454 is twisted, so that the co-plainer pairs of target impact areas are disposed about 90 degrees or generally perpendicular to one another. In such a configuration, the target 430 becomes self-supporting on the ground and the arms will always hold one of the target impact areas above the others, thereby providing a target. When the target is impacted, the force will cause that target impact area to rotate downwardly and another target impact area to rise into position.

Figure 18:
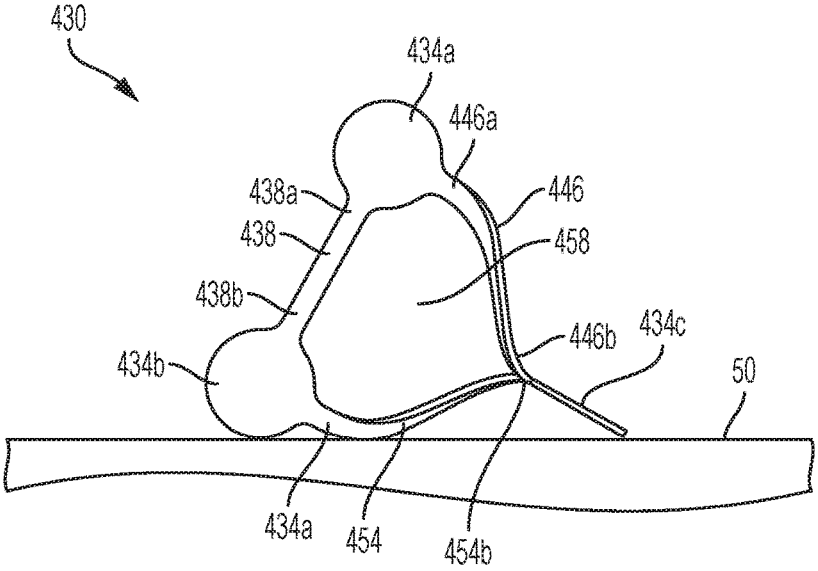
FIG. 18 shows a side view of the target of FIG. 17 disposed on the ground.

FIG. 18 shows a front view of the target 430 based on the orientation shown in FIG. 16. The first target impact area 434*a* and the second target impact area 434*b* remain on the left side and connected by the first arm 438. However, because the third arm 446 and the fourth arm 454 have been twisted, the third target impact area 434*c* and the fourth target impact area 434*d* are perpendicular to the target impact areas of the other portion, thereby allowing both to rest on the ground 50, and hold the first target impact area 434*a* above the other three target impact areas. When a shooter properly impacts the first target impact area 434*a*, the force will cause it to rotate down 90 degrees and will lift the third target impact area 434*c* to the upper position. Hitting the third target impact area 434*c* will likewise cause it to rotate 90 degrees, thereby lifting the second target impact area 434*b*. Hitting the second target impact area 434*b* will cause rotation to lift the fourth target impact area 434*d*, etc. It will be appreciated that an impact from a high caliber/high velocity round may cause the target 430 to advance more than 90 degrees at a time (i.e. it may cause the target to move two "steps" forward and lift the second target impact area 434*b*, etc.).

Figure 19:
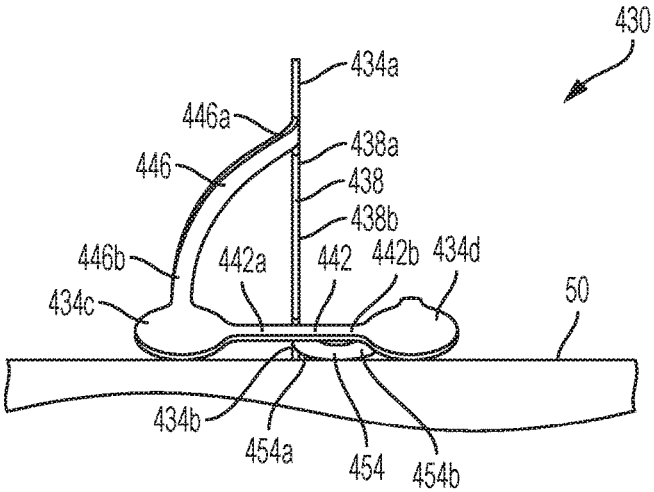
FIG. 19 shows a front view of the target shown in FIG. 17 with the target resting on the ground.

FIG. 19 shows a side view of the configuration of FIG. 15 after the third arm 446 and the fourth arm 454 have been bent in a partial helical formation so that the faces of the first and second target impact areas 434*a*, 434*b* are generally perpendicular to the faces of the third and fourth target impact areas 434*c*, 434*d*. The second, third and fourth target impact areas 434*b*, 434*c*, 434*d* are resting on the ground 50. It will be appreciated that the target 430 can be shot from either side, which will reverse the order in which the different target impact areas 434*b*-434*d* are presented.

Figure 21:
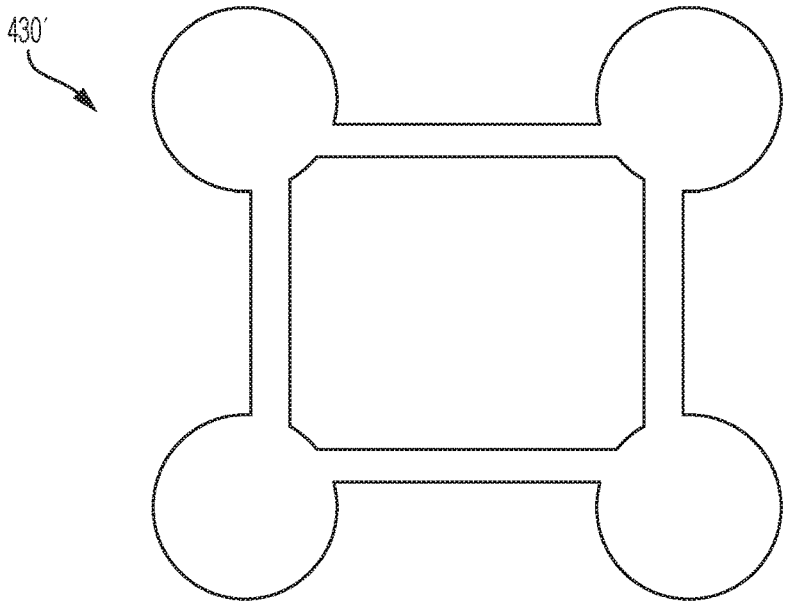
FIG. 21 shows a plan view of yet another target made in accordance with the principles of the present disclosure.

While FIGS. 16-19 show the arm extending from approximately the middle of the side of the target impact areas it will be appreciated that for several shapes of target impact areas, it will be preferred to have the arms extend from a point lower on the side so that the curved arms do not interfere with the target impact areas resting on the ground. Thus, for example, the arms could essentially join together or be closely adjacent one another at a position at the lower inside edge of the target impact plate as shown in target 430' in FIG. 21.

FIG. 20 shows a plan (unbent) view of yet another configuration of a target, generally indicated at 530, made in accordance with principles of the present disclosure. It will be appreciated that the various aspects of the different configurations discussed herein may be integrated with one another and a target made according to this disclosure may have combinations of the structures shown in the drawings.

The configuration shown in FIG. 20 differs from the prior configurations in that the target includes two first target impact areas 534*a*1 and 534*a*2 at one end of a first arm 538, with the two first target impact areas being connected by a connector arm 562. Likewise, a pair of second target impact areas 534*b*1 and 534*b*2 extend from an opposing end of the first arm 538 and are connected by a second connector arm 564. A pair of third target impact areas 534*c*1 and 534*c*2 are disposed at one end of second arm 542, and are connected together by a third connector arm 572, and a pair of fourth target impact areas 534*d*1 and 534*d*2 extend from the other end of the second arm 542, with the fourth target impact areas being connected by a forth connector arm 568.

A third arm 546 may connect the first target impact areas 534*a*1 and 534*a*2 to the third target impact areas 534*c*1 and 534*c*2, and a fourth arm 554 may connect the second target impact areas 534*b*1 and 534*b*2 to the fourth target impact areas 534*d*1 and 534*d*2. In the alternative, a single third arm 546 may connect the first arm 538 and the second arm 542, or a pair of arms (or a single arm with a slot therein similar to FIG. 13) could be used to connect the arms.

The target 530 may then be bent, so that the first and second target impact areas 534*a*1, 534*a*2, 534*b*1 and 534*b*2 are disposed generally parallel to one another and generally perpendicular to the third and fourth target impact areas 534*c*1, 534*c*2, 534*d*1 and 534*d*2. The target impact areas can be any desired shape and may be used for different caliber rounds. For example, the outermost target impact areas may be used with smaller caliber weapons because the farther the impact occurs from the center of mass, the greater the force will be applied to rotate the target.

While not required, the target impact areas may generally be wider than the arm connecting them, usually between 1.5 and 4 times the width to give an adequate sized area to shoot at while still keeping the overall mass of the target relatively low. Any desired shape may be used for the target impact areas and the target areas may be colored to indicate which target is being presented.

Thus there is disclosed a walking target. The target may be formed from a single piece of metal, thereby reducing the risk of a weld breaking or a bolt being lost, and reducing cost and reducing the risk of splatter coming off a bolt or flange. The walking target may be formed in multiple different shapes and configurations. It will be appreciated that numerous modifications can be made in light of the present disclosure. It will be further appreciated that aspects from the various embodiments of the invention may be combined. The appended claims are intended to cover such modifications.

What is claimed is:

1. A target having:

a first target impact area and a second target impact area, the second target impact area being connected to the first target impact area by a first arm;

a third target impact area and fourth target impact area, the third target impact area being connected to the fourth target impact area by a second arm, wherein the target is formed from a single piece of unwelded material twisted or bent so as to dispose the first target impact area and the second target impact area generally parallel to one another and the third target impact area and the fourth target impact area generally parallel with one another, and wherein the first target impact area and the third impact area are disposed in different planes; and a third arm attached to the second arm at an approximate a midpoint of the second arm.

2. The target of claim 1, wherein the third target impact area is disposed in a first plane generally perpendicular to a second plane in which the first impact area is disposed.

3. A target having:

a first target impact area and a second target impact area, the second target impact area being connected to the first target impact area by a first arm;

a third target impact area and fourth target impact area, the third target impact area being connected to the fourth target impact area by a second arm, wherein the target is formed from a single piece of material twisted or bent so as to dispose the first target impact area and the second target impact area generally parallel to one another and the third target impact area and the fourth target impact area generally parallel with one another, and wherein the first target impact area and the third impact area are disposed in different planes, and wherein the target further comprises a third arm connecting the first arm and the second arm, and wherein the third arm is twisted so that opposing ends are offset by approximately 90 degrees.

4. The target of claim 3, wherein the first arm, second arm and third arm are sized such that when the first, second, and third target impact areas rest on a surface, the fourth impact area is disposed above the first, second, and third target impact area and within a generally triangular volume extending upwardly from the first, second and third target impact areas.

5. The target of claim 1, wherein the first arm extends generally perpendicular to the second arm.

6. The target of claim 1, wherein the first arm has a width and wherein the first target impact area and second target impact area each have a width at least twice as wide as the width of the arm.

7. The target of claim 1, wherein the first arm and the second arm are different lengths.

8. A target having:

a first target impact area and a second target impact area, the second target impact area being connected to the first target impact area by a first arm;

a third target impact area and fourth target impact area, the third target impact area being connected to the fourth target impact area by a second arm, wherein the target is formed from a single piece of material twisted or bent so as to dispose the first target impact area and the second target impact area generally parallel to one another and the third target impact area and the fourth target impact area generally parallel with one another, and wherein the first target impact area and the third impact area are disposed in different planes, and wherein the first target impact area and the second target impact area form one portion of the target, and wherein the third target impact area and the fourth target impact area form a second portion of the target, and wherein the target further comprises at least one arm connecting the first portion to the second portion.

9. The target of claim 8, wherein the at least one arm connecting the first portion to the second portion has a slot formed therein.

10. The target of claim 8, wherein the at least one arm connecting the first portion to the second portion includes two arms.

11. The target of claim 10, wherein the two arms are bent into a partially helical configuration.

12. A movable target comprising a first target impact area, a second target impact area, a third target impact area and a fourth target impact area, and a plurality of arms connecting the target impact areas, wherein the target is made from a single piece of metal which is not welded together;

wherein the plurality of arms includes a first arm connecting the first target impact area and second target impact area, a second arm connecting the third target impact area and fourth target impact area, and a third arm connecting the first arm and the second arm; and wherein the third arm is twisted.

13. The movable target of claim 12, wherein the third target impact area and fourth target impact area are disposed in a first plane and wherein the first target impact area is disposed in a second plane different from the first plane.

14. The movable target of claim 13, wherein the first target impact area is disposed in a plane generally perpendicular to a plane in which the third target impact area is disposed.

15. The movable target of claim 13, wherein the first target impact area is formed by a generally circular portion of a piece of the metal.

16. A movable target formed a single, unwelded piece of plate steel, the target comprising a first target impact area, a second target impact area, a third target impact area and a fourth target impact area, a first arm connecting the first target impact area to the second target impact area, a second arm connecting the third target impact area to the fourth target impact area and a third arm attached to the first arm and the second arm between the target impact areas, the third arm being twisted so that the first arm and the second arm extend in generally perpendicular directions.

17. A method for forming a walking target, the method comprising:

selecting a sheet of metal;

cutting the sheet of metal to form a cut piece of metal, the cut piece of metal forming a first target impact area and a second target impact area, the second target impact area being connected to the first target impact area by a first arm, a third target impact area and fourth target impact area, the third target impact area connected to the fourth target impact area by a second arm, wherein the target is formed from a single piece of unwelded material, and a third arm attached to the second arm at an approximate a midpoint of the second arm; and twisting the third arm so as to dispose the first target impact area and the second target impact area generally parallel to one another and the third target impact area and the fourth target impact area generally parallel with one another, and wherein the first target impact area and the third impact area are disposed in different planes.

18. The method according to claim 17, wherein the step of twisting the third arm forms a twist, wherein at least two target impact areas are on one side of the twist and at least one target impact area is on another side of the twist.

19. The method according to claim 17, wherein the method comprising twisting the third arm so that two of the target impact areas are generally in a first plane and two of the target impact areas are in another plane, generally perpendicular to the first plane.

* * * * *